US010753132B2

(12) United States Patent
Roberts et al.

(10) Patent No.: US 10,753,132 B2
(45) Date of Patent: Aug. 25, 2020

(54) DOOR RESTRAINT ASSEMBLY

(71) Applicants: Brock Roberts, St. Clair, MO (US); Braydon Roberts, St. Clair, MO (US)

(72) Inventors: Brock Roberts, St. Clair, MO (US); Braydon Roberts, St. Clair, MO (US)

( * ) Notice: Subject to any disclaimer, the term of this patent is extended or adjusted under 35 U.S.C. 154(b) by 21 days.

(21) Appl. No.: 16/006,965

(22) Filed: Jun. 13, 2018

(65) Prior Publication Data

US 2019/0383076 A1 Dec. 19, 2019

(51) Int. Cl.
*E05D 11/06* (2006.01)
*E05D 11/10* (2006.01)
*E05D 3/02* (2006.01)

(52) U.S. Cl.
CPC ..... *E05D 11/06* (2013.01); *E05D 3/02* (2013.01); *E05D 11/1078* (2013.01)

(58) Field of Classification Search
CPC ..... E05D 11/06; E05D 11/10; E05D 11/1078
USPC ..... 16/337, 341, 342, 388, 360, 361
See application file for complete search history.

(56) References Cited

U.S. PATENT DOCUMENTS 1,200,538 A * 10/1916 Smith ..... E05D 11/1078 16/303
1,455,550 A * 5/1923 Rodell ..... E05D 11/06 16/375
2,057,269 A * 10/1936 Schreiber ..... E05D 7/1005 16/263
2,456,537 A 12/1948 Seaman
2,538,679 A * 1/1951 Foltis ..... E05F 3/20 16/68
2,803,850 A * 8/1957 Hooper ..... E05D 11/06 16/341
2,990,572 A * 7/1961 Schwartzberg ..... E05D 11/06 16/375
4,155,144 A 5/1979 Koganei
4,697,302 A * 10/1987 Yuenian ..... E05F 1/1223 16/52
4,788,746 A * 12/1988 Idler ..... B64G 1/222 16/297
4,829,628 A 5/1989 Vuksie
5,652,694 A * 7/1997 Martin ..... G06F 1/1616 16/223
6,928,699 B2 8/2005 Sawa
7,966,693 B2 6/2011 Choi
8,510,911 B2 8/2013 Sawa
9,353,564 B2 5/2016 Bacchetti
2010/0251520 A1* 10/2010 Corso ..... E05D 5/12 16/342
2013/0219664 A1* 8/2013 Burda ..... E05D 11/06 16/374
2015/0204128 A1* 7/2015 Bacchetti ..... E05F 1/1223 16/53

* cited by examiner

*Primary Examiner* — Emily M Morgan

(57) ABSTRACT

A door restraint assembly for inhibiting a door from striking a wall when the door is opened includes a hinge unit that is hingedly coupled between a door and a door frame. A limiting unit is rotatably positioned in the hinge unit. The limiting unit limits rotation of the hinge unit when the door is opened. In this way the limiting unit inhibits the door from striking an adjacent wall when the door is opened.

10 Claims, 4 Drawing Sheets

DOOR RESTRAINT ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to restraint devices and more particularly pertains to a new restraint device for inhibiting a door from striking a wall when the door is opened.

BRIEF SUMMARY OF THE INVENTION

An embodiment of the disclosure meets the needs presented above by generally comprising a hinge unit that is hingedly coupled between a door and a door frame. A limiting unit is rotatably positioned in the hinge unit. The limiting unit limits rotation of the hinge unit when the door is opened. In this way the limiting unit inhibits the door from striking an adjacent wall when the door is opened.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
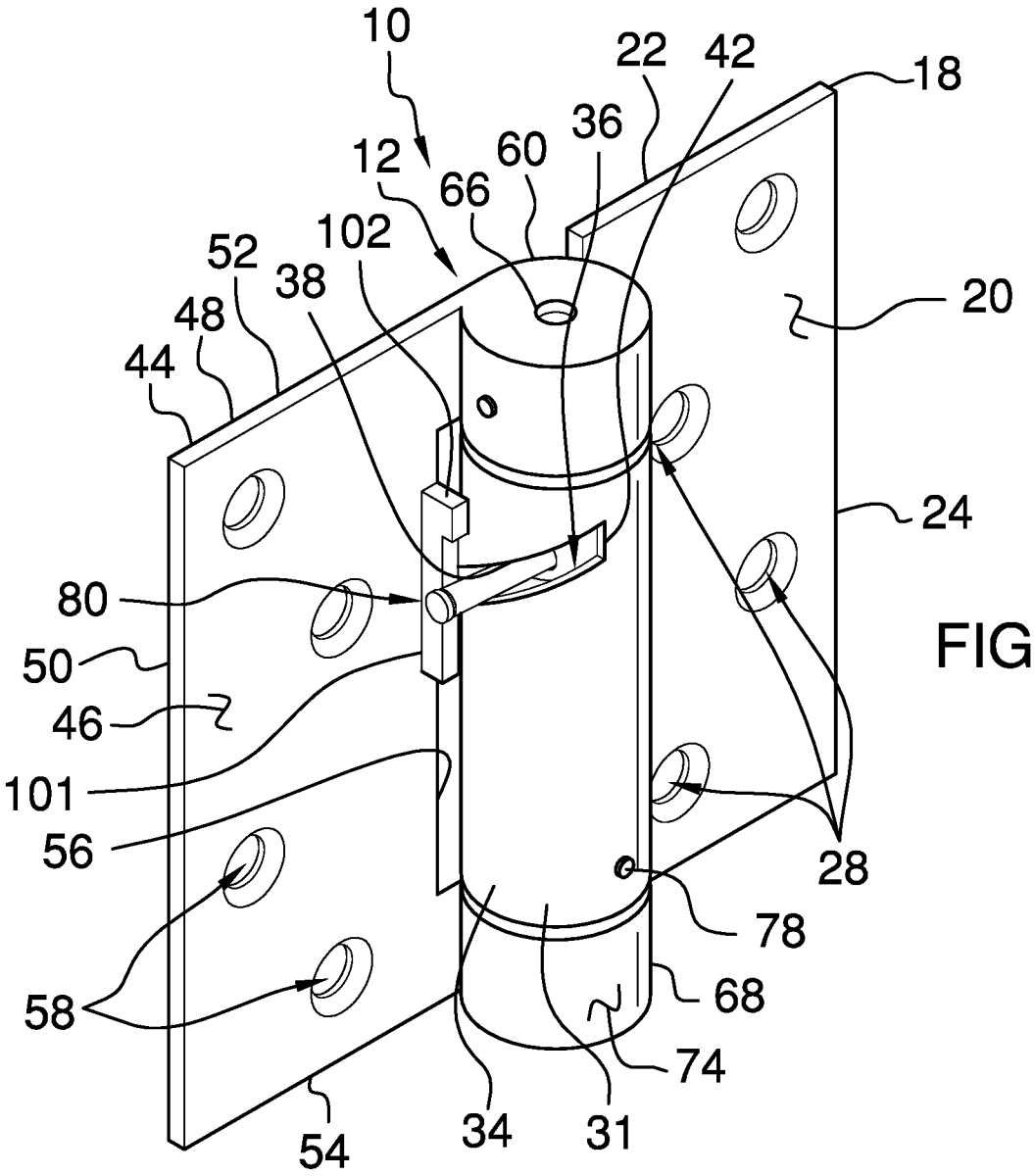
FIG. 1 is a perspective view of a door restraint assembly according to an embodiment of the disclosure.
Figure 2:
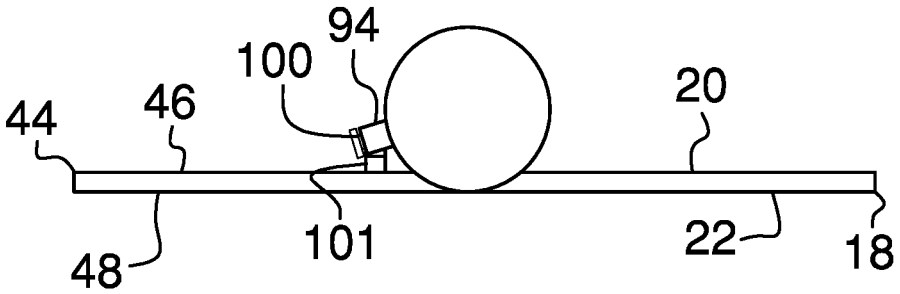
FIG. 2 is a bottom view of an embodiment of the disclosure.
Figure 3:
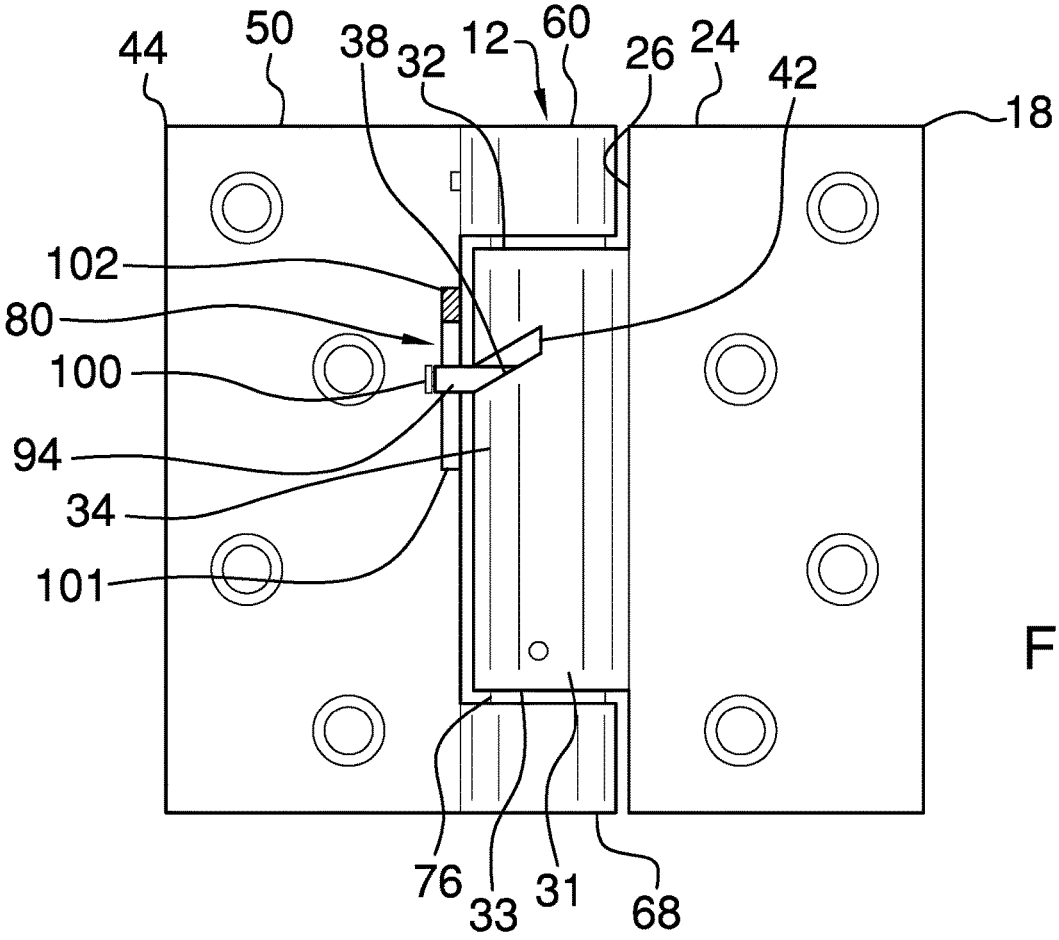
FIG. 3 is a front view of an embodiment of the disclosure.
Figure 4:
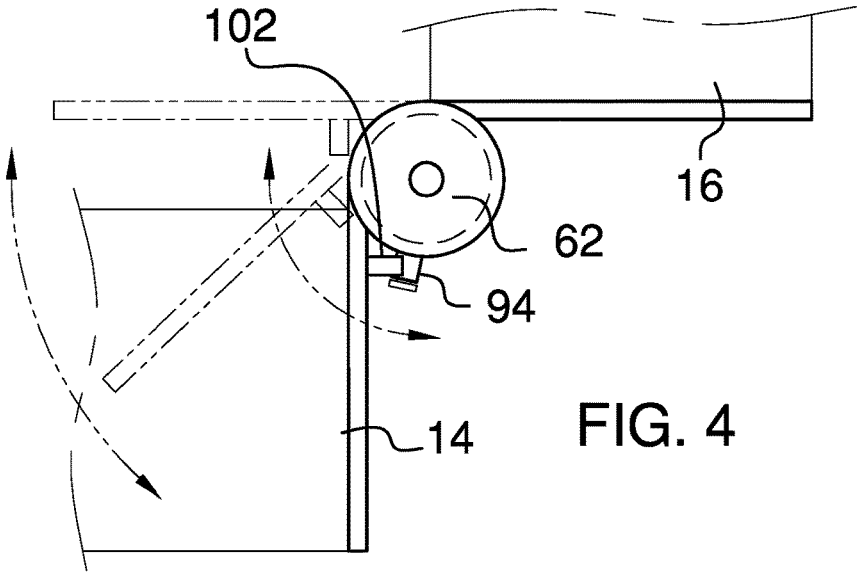
FIG. 4 is a top view of an embodiment of the disclosure.
Figure 5:
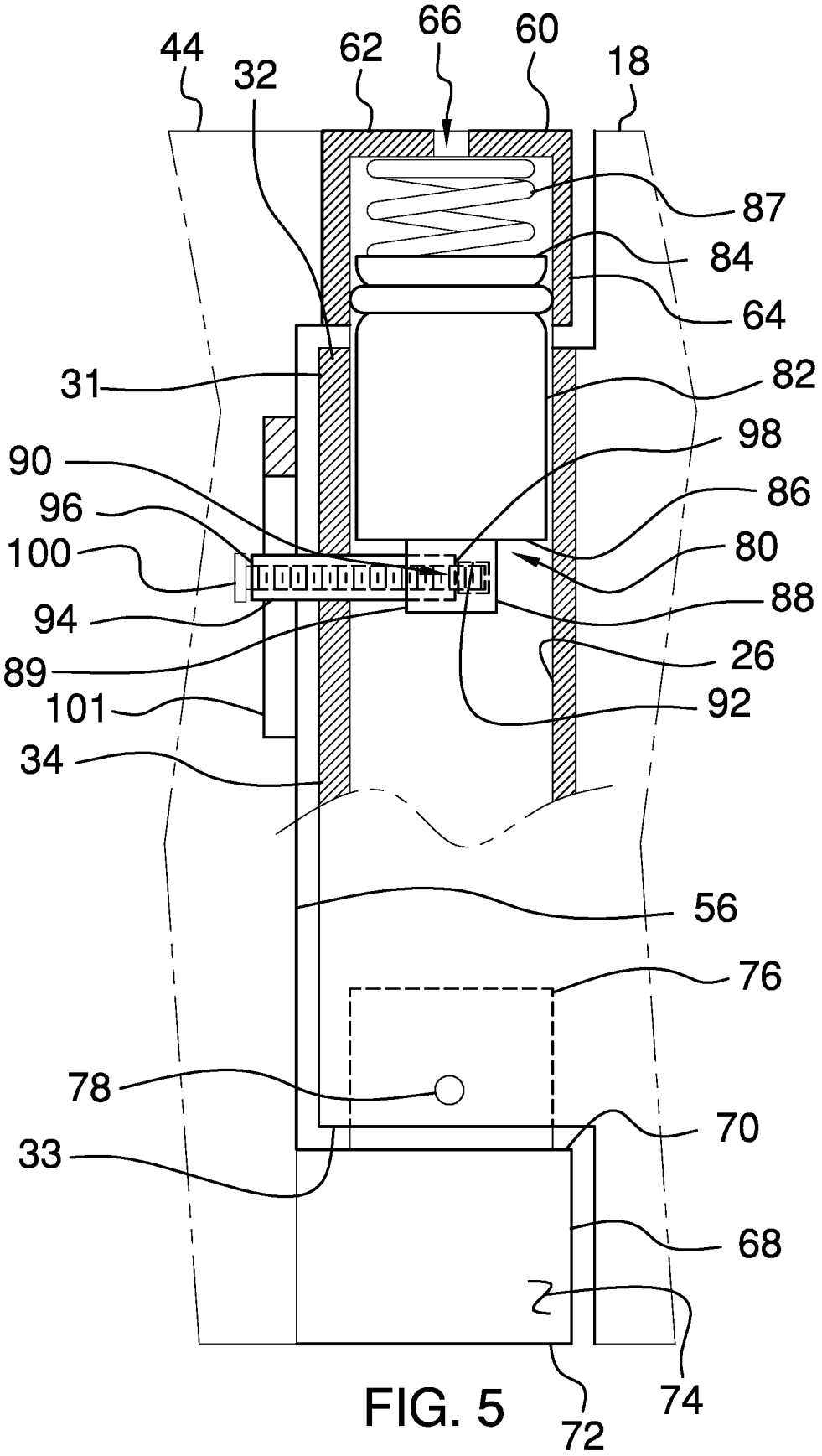
FIG. 5 is a front cut-away view of an embodiment of the disclosure.
Figure 6:
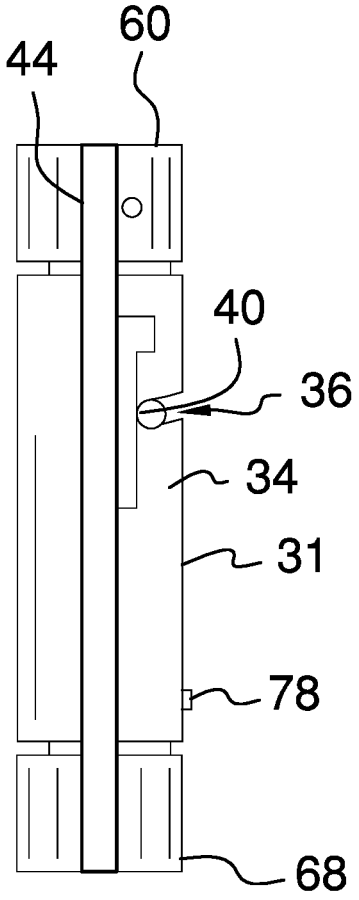
FIG. 6 is a left side view of an embodiment of the disclosure.

With reference now to the drawings, and in particular to FIGS. 1 through 6 thereof, a new restraint device embodying the principles and concepts of an embodiment of the disclosure and generally designated by the reference numeral 10 will be described.

As best illustrated in FIGS. 1 through 6, the door restraint assembly 10 generally comprises a hinge unit 12 that is hingedly coupled between a door 14 and a door frame 16. Each of the door 14 and the door frame 16 may be components of an entry into a building, an entry into a room in a building or other type of man door 14. The hinge unit 12 comprises a first panel 18 that has a first surface 20, a second surface 22 and perimeter edge 24 extending therebetween. The perimeter edge 24 has a first side 26, and the first panel 18 has a plurality of first apertures 28 each extending through the first 20 and second 22 surfaces. The first surface 20 of the first panel 18 is coupled to the door frame 16.

The hinge unit 12 includes a tube 31 that has a first end 32, a second end 33 and an outer wall 34 extending therebetween. The outer wall 34 is coupled to the first side 26 of the perimeter edge 24 of the first panel 18 having the tube 31 being oriented collinear with the first side 26. The outer wall 34 has a slot 36 extending into an interior of the tube 31. The slot 36 has a bounding edge 38 and the bounding edge 38 has a primary end 40 a secondary end 42. Moreover, the slot 36 angles upwardly on the outer wall 34 between the primary end 40 and the secondary end 42.

The hinge unit 12 includes a second panel 44 that has a primary surface 46, a secondary surface 48 and an outer edge 50 extending therebetween. The outer edge 50 has a top side 52, a bottom side 54 and a lateral side 56 extending therebetween. The second panel 44 has a plurality of second apertures 58 each extending through the primary 46 and secondary 48 surfaces, and the primary surface 46 of the second panel 44 is coupled to the door 14. Fasteners, such as screws or the like, are extended through the first and second apertures 58 to fasten the hinge unit 12 to the door 14 and the door frame 16.

The hinge unit 12 includes a cup 60 that has an upper wall 62 and an outer wall 64 extending downwardly therefrom. The outer wall 34 of the cup 60 is coupled to the lateral side 56 of the outer edge 50 of the second panel 44 having the upper wall 62 being aligned with the top side 52 of the outer edge 50 of the second panel 44. Additionally, the upper wall 62 has an air hole 66 extending therethrough. The hinge unit 12 additionally includes a cylinder 68 that has an upper surface 70, a lower surface 72 and an exterior surface 74 extending therebetween. The exterior surface 74 is coupled to the lateral side 56 of the outer edge 50 of the second panel 44 having the lower surface 72 being aligned with the bottom side 54 of the outer edge 50 of the second panel 44. Additionally, the cylinder 68 is positioned between and is aligned with each of the cup 60 and the cylinder 68.

A pin 76 is coupled to and extends upwardly from the upper surface 70 of the cylinder 68. The second end 33 of the tube 31 insertably receives the pin 76 such that the cylinder 68 is rotatably coupled to the tube 31. A first retainer 78, such as a removable pin or the like, extends through the cylinder 68 and engages the pin 76 to inhibit the pin 76 from being removed from the cylinder 68. The pin 76 may have a groove therein or the like that the first retainer 78 engages thereby allowing the first retainer 78 to travel along the pin 76 while inhibiting the pin 76 from being removed from the cylinder 68.

A limiting unit 80 is rotatably positioned in the hinge unit 12. The limiting unit limits rotation of the hinge unit 12 when the door 14 is opened. Moreover, the limiting unit 80 inhibits the door 14 from striking an adjacent wall when the door 14 is opened. In this way the limiting unit 80 protects the wall from being damaged by the door 14 when the door 14 is opened. The limiting unit 80 comprises a spindle 82 that has a first end 84 and a second end 86. The spindle 82 is movably positioned within the tube 31 having the spindle 82 extending out of the first end 32 of the tube 31 and extending into the cup 60. Moreover, the spindle 82 is urgeable upwardly toward the air hole 66 in the cup 60 and downwardly away from the air hole 66 in the cup 60.

A biasing member 87 is positioned within the cup 60 and the biasing member 87 is positioned between the first end 32 of the spindle 82 and the upper wall 62 of the cup 60. The biasing member 87 biases the spindle 82 downwardly from the air hole 66 in the cup 60. A tab 88 is coupled to and extends downwardly from the second end 33 of the spindle 82. The tab 88 has an outwardly facing surface 89, and the outwardly facing surface 89 has a well 90 extending inwardly toward a center of the tab 88. The well 90 has a bounding surface 92 and the bounding surface 92 of the well 90 is threaded.

The limiting unit 80 includes a sleeve 94 that has a first end 96 and a second end 98. The well 90 insertably receives the second end 98 of the sleeve 94 and the sleeve 94 extends outwardly through the slot 36 in the tube 31. Additionally, the first end 96 of the sleeve 94 is exposed with respect to the tube 31. A screw 100 extends into the first end 96 of the sleeve 94 and threadably engages the bounding surface 92 of the well 90 such that the sleeve 94 is removably coupled to the tab 88.

The limiting unit 80 additionally includes a stop 101 that is coupled to the secondary surface 48 of the second panel 44. The stop 101 is aligned with and is oriented collinear with the lateral side 56 of the outer edge 50 of the second panel 44. The stop 101 has a foot 102 extending outwardly therefrom, and the stop 101 frictionally engages the sleeve 94 when the door 14 is opened. The stop 101 urges the sleeve 94 to travel along the slot 36 when the door 14 is opened such that the sleeve 94 travels upwardly in the slot 36 when the door 14 is opened. Additionally, the sleeve 94 urges the spindle 82 upwardly in the cup 60 when the sleeve 94 travels upwardly in the slot 36. Air in the cup 60 passes through the air hole 66 when the spindle 82 is urged upwardly in the cup 60 to depressurize the interior of the cup 60 when the spindle 82 is urged upwardly. The sleeve 94 abuts the secondary end 42 of the bounding edge 38 of the slot 36 when the door 14 is fully opened.

The sleeve 94 slides upwardly along the stop 101 when the door 14 is opened. Moreover, the sleeve 94 abuts the foot 102 on the stop 101 at the same time that the sleeve 94 abuts the secondary end 42 of the bounding edge 38 of the slot 36. In this way motion of the second panel 44 is stopped when the door 14 is fully opened thereby inhibiting the door 14 from striking the wall when the door 14 is opened. The biasing member 87 biases the spindle 82 downwardly in the cylinder 68 when the door 14 is released. Thus, the sleeve 94 travels downwardly in the slot 36 toward the primary end 40 of the bounding edge 38 of the slot 36.

In use, the hinge unit 12 is coupled between the door 14 and the door frame 16 as a replacement of a conventional door 14 hinge. The stop 101 engages the sleeve 94 when the door 14 is opened thereby urging the sleeve 94 to travel upwardly along the slot 36. The sleeve 94 travels along the slot 36 until the sleeve 94 abuts the secondary end 42 of the bounding edge 38 of the slot 36. At the same time, the sleeve 94 abuts the foot 102 on the stop 101 thereby restricting the second panel 44 from travelling any further when the door 14 is opened. In this way the door 14 is restricted from striking the wall, and potentially damaging the wall, when the door 14 is opened. The biasing member 87 biases the spindle 82 downwardly, which in turn urges the sleeve 94 to travel toward the primary end 40 of the bounding edge 38 of the slot 36, when the door 14 is released.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A door restraint assembly comprising:

a hinge unit being hingedly coupled between a door and a door frame, said hinge unit comprising a first panel having a first surface, a second surface and a perimeter edge extending therebetween, said perimeter edge having a first side, said first panel having a plurality of first apertures each extending through said first and second surfaces, said first surface of said first panel being coupled to the door frame, a tube having a first end, a second end and an outer wall extending therebetween, said outer wall being coupled to said first side of said perimeter edge of said first panel, a second panel having a primary surface, a secondary surface and an outer edge extending therebetween, said outer edge having a top side, a bottom side and a lateral side extending therebetween, said second panel having a plurality of second apertures each extending through said primary and secondary surfaces, said primary surface of said second panel being coupled to the door, a cup having an upper wall and an outer wall extending downwardly therefrom, said outer wall of said cup being coupled to said lateral side of said outer edge of said second panel having said upper wall being aligned with said top side of said outer edge of said second panel, said upper wall has an air hole extending therethrough;

a cylinder having an upper surface, a lower surface and an exterior surface extending therebetween, said exterior surface being coupled to said lateral side of said outer edge of said second panel having said lower surface being aligned with said bottom side of said outer edge of said second panel, said tube being positioned between and being aligned with each of said cup and said cylinder; and a limiting unit being rotatably positioned in said hinge unit, said limiting unit limiting rotation of said hinge unit when the door is opened wherein said limiting unit is configured to inhibit the door from striking an adjacent wall when the door is opened, said limiting unit comprising a spindle having a first end and a second end, said spindle being movably positioned within said tube having said spindle extending out of said first end of said tube and extending into said cup, said spindle being urgeable upwardly toward said air hole in said cup and downwardly away from said air hole in said cup, a biasing member being positioned within said cup, said biasing member being positioned between said first end of said spindle and said upper wall of said cup, said biasing member biasing said spindle downwardly from said air hole in said cup, and a tab being coupled to and extending downwardly from said second end of said spindle, said tab having an outwardly facing surface, said outwardly facing surface having a well extending inwardly toward a center of said tab, said well having a bounding edge, said bounding edge of said well being threaded.

2. The assembly according to claim 1, wherein said hinge unit further comprises said outer wall having a slot extending into an interior of said tube, said slot having a bounding edge, said bounding edge having a primary end a secondary end, said slot angling upwardly on said outer wall between said primary end and said secondary end.

3. The assembly according to claim 1, wherein said hinge unit further comprises:

a pin being coupled to and extending upwardly from said upper surface of said cylinder, said second end of said tube insertably receiving said pin such that said cylinder is rotatably coupled to said tube; and a first retainer extending through said cylinder and engaging said pin to inhibit said pin from being removed from said tube.

4. The assembly according to claim 1, wherein said limiting unit further comprises a sleeve having a first end and a second end, said well insertably receiving said second end of said sleeve having said sleeve extending outwardly through said slot in said tube having said first end of said sleeve being exposed with respect to said tube.

5. The assembly according to claim 4, wherein said limiting unit further comprises a screw extending into said first end of said sleeve and threadably engaging said bounding edge of said well such that said sleeve is removably coupled to said tab.

6. The assembly according to claim 4, wherein said limiting unit further comprises a stop being coupled to said secondary surface of said second panel, said stop being aligned with and being oriented collinear with said lateral side of said outer edge of said second panel, said stop having a foot extending outwardly therefrom.

7. The assembly according to claim 6, wherein said limiting unit further comprises:

said stop frictionally engages said sleeve when the door is opened, said stop urging said sleeve to travel along said slot when the door is opened such that said sleeve travels upwardly in said slot when the door is opened;

said sleeve urges said spindle upwardly in said cup when said sleeve travels upwardly in said slot having air passing through said air hole; and said sleeve abuts said secondary end of said bounding edge of said slot when the door is fully opened.

8. The assembly according to claim 7, wherein said limiting unit further comprises said sleeve being slidable upwardly along said stop when the door is opened, said sleeve abutting said foot on said stop when said sleeve abuts said secondary end of said slot thereby inhibiting the door from being opened further wherein said stop is configured to inhibit the door from striking the wall when the door is opened.

9. The assembly according to claim 8, wherein said limiting unit further comprises said biasing member biasing said spindle downwardly in said cylinder when the door is released such that said sleeve travels downwardly in said slot toward said primary end of said bounding edge of said slot.

10. A door restraint assembly comprising:

a hinge unit being hingedly coupled between a door and a door frame, said hinge unit comprising:

a first panel having a first surface, a second surface and perimeter edge extending therebetween, said perimeter edge having a first side, said first panel having a plurality of first apertures each extending through said first and second surfaces, said first surface of said first panel being coupled to the door frame;

a tube having a first end, a second end and an outer wall extending therebetween, said outer wall being coupled to said first side of said perimeter edge of said first panel, said outer wall having a slot extending into an interior of said tube, said slot having a bounding edge, said bounding edge having a primary end an secondary end, said slot angling upwardly on said outer wall between said primary end and said secondary end;

a second panel having a primary surface, a secondary surface and an outer edge extending therebetween, said outer edge having a top side, a bottom side and a lateral side extending therebetween, said second panel having a plurality of second apertures each extending through said primary and secondary surfaces, said primary surface of said second panel being coupled to the door;

a cup having an upper wall and an outer wall extending downwardly therefrom, said outer wall of said cup being coupled to said lateral side of said outer edge of said second panel having said upper wall being aligned with said top side of said outer edge of said second panel, said upper wall having an air hole extending therethrough;

a cylinder having an upper surface, a lower surface and an exterior surface extending therebetween, said exterior surface being coupled to said lateral side of said outer edge of said second panel having said lower surface being aligned with said bottom side of said outer edge of said second panel, said tube being positioned between and being aligned with each of said cup and said cylinder;

a pin being coupled to and extending upwardly from said upper surface of said cylinder, said second end of said tube insertably receiving said pin such that said cylinder is rotatably coupled to said tube; and a first retainer extending through said cylinder and engaging said pin to inhibit said pin from being removed from said tube; and a limiting unit being rotatably positioned in said hinge unit, said limiting unit limiting rotation of said hinge unit when the door is opened wherein said limiting unit is configured to inhibit the door from striking an adjacent wall when the door is opened, said limiting unit comprising:

a spindle having a first end and a second end, said spindle being movably positioned within said tube having said spindle extending out of said first end of said tube and extending into said cup, said spindle being urgeable upwardly toward said air hole in said cup and downwardly away from said air hole in said cup;

a biasing member being positioned within said cup, said biasing member being positioned between said first end of said spindle and said upper wall of said cup, said biasing member biasing said spindle downwardly from said air hole in said cup;

a tab being coupled to and extending downwardly from said second end of said spindle, said tab having an outwardly facing surface, said outwardly facing surface having a well extending inwardly toward a center of said tab, said well having a bounding edge, said bounding edge of said well being threaded;

a sleeve having a first end and a second end, said well insertably receiving said second end of said sleeve having said sleeve extending outwardly through said slot in said tube having said first end of said sleeve being exposed with respect to said tube;

a screw extending into said first end of said sleeve and threadably engaging said bounding edge of said well such that said sleeve is removably coupled to said tab; and a stop being coupled to said secondary surface of said second panel, said stop being aligned with and being oriented collinear with said lateral side of said outer edge of said second panel, said stop having a foot extending outwardly therefrom, said stop frictionally engaging said sleeve when the door is opened, said stop urging said sleeve to travel along said slot when the door is opened such that said sleeve travels upwardly in said slot when the door is opened, said sleeve urging said spindle upwardly in said cup when said sleeve travels upwardly in said slot having air passing through said air hole, said sleeve abutting said secondary end of said bounding edge of said slot when the door is fully opened, said sleeve sliding upwardly along said stop when the door is opened, said sleeve abutting said foot on said stop when said sleeve abuts said secondary end of said slot thereby inhibiting the door from being opened further wherein said stop is configured to inhibit the door from striking the wall when the door is opened, said biasing member biasing said spindle downwardly in said cylinder when the door is released such that said sleeve travels downwardly in said slot toward said primary end of said bounding edge of said slot.

* * * * *